United States Patent [19]

Bouladon et al.

[11] Patent Number: 4,481,741

[45] Date of Patent: Nov. 13, 1984

[54] POLISHING MACHINES INCORPORATING ROTATING PLATE

[76] Inventors: Gabriel Bouladon, Les Martinets B, 38610 Gieres; Lucien Grisel, Les Combes, Herbeys 38320, both of France

[21] Appl. No.: 466,688

[22] Filed: Feb. 15, 1983

[30] Foreign Application Priority Data

Mar. 26, 1982 [FR] France ..... 82 05687

[51] Int. Cl.[3] ..... B24B 5/00

[52] U.S. Cl. ..... 51/131.1; 51/109 R; 51/131.3; 51/266; 51/318; 51/322; 51/326

[58] Field of Search ..... 51/131.1, 131.3, 266, 51/322, 326, 317, 318, 109 R

[56] References Cited

U.S. PATENT DOCUMENTS 873,340 12/1907 Bagnall ..... 51/131.3

FOREIGN PATENT DOCUMENTS 2617705 4/1976 Fed. Rep. of Germany .... 51/131 C

*Primary Examiner*—Frederick R. Schmidt
*Assistant Examiner*—J. T. Zatarga
*Attorney, Agent, or Firm*—Dowell & Dowell

[57] ABSTRACT

The invention relates to improvements in polishing machines incorporating a rotating plate. The upper face of the rotating plate is provided with a groove of circular section, in which is removably retained the base of a collar or screen, which defines on said plate two separate zones for rough-machining and finishing. The invention also relates to the mode of heat-conditioning the plate with the aid of nozzles disposed in the bottom of the tank for spraying a liquid against the lower face of said plate.

6 Claims, 3 Drawing Figures

POLISHING MACHINES INCORPORATING ROTATING PLATE

The present invention relates to machines used for polishing metallographic samples or like workpieces, and more particularly wafers intended for the manufacture of semi-conductors.

Known machines of this type generally comprise a circular plate animated by a continuous movement of rotation and on the side of which is provided at least one turret equipped with a horizontal arm which extends in overhang over the rotating plate. This arm may be displaced angularly and its free end is adapted to receive a workpiece-holder with which are associated on the one hand means adapted to drive it in rotation and on the other hand a device ensuring vertical thrust. The workpiece to be polished, fixed on the holder, is thus applied by force against the surface of the plate suitably sprayed with an abrasive suspended in a liquid such as water, oil or the like; the pressure of application of the workpiece combined with the rotation of said workpiece and with the rotation of the plate ensure efficient polishing.

The polishing operation is most often carried out in two successive phases, in that each workpiece undergoes a first rough-machining or roughing pass before being subjected to a finishing pass; the differentiation of the two work phases mainly concern the nature and particle-size of the abrasive used, as well as the pH, the rate of flow and the nature of the carrier liquid, but it is often advantageous to employ covering substrates of different natures for the rotating plate. Under these conditions, it is clear that, to be in a position to proceed with a complete polishing operation, the operator must either have two different plates placed successively in position on the machine, or must replace the substrate between the two phases. In both cases, this is a tedious operation which slows down the rate of production of the machine.

It is a principal object of the present invention to overcome this drawback, essentially by proposing arranging on the surface of the rotating plate two concentric work zones separated from each other by a groove of circular profile which is adapted to retain a removable screen in the form of a collar and at the same time to form collector for the slurries and abrasive liquids evacuated through suitably spaced apart perforations.

It is obvious that the two zones of the plate determined by the separating groove are advantageously provided with different covering substrates, whilst being supplied with different abrasive solutions, so that the two phases of roughing and finishing may be effected successively by simple passage of the workpiece-holder from one zone to the other, the collar avoiding any projection of abrasive liquid during opeation and thus any risk of mixing. This collar is adapted to be momentarily removed from the groove with a view to facilitating passage of the workpiece to be polished from the peripheral roughing zone to the central finishing zone, or to allowing the use of the rotating plate as in a conventional machine.

The invention also proposes solving the problem of heat conditioning the rotating plate of the polishing machines. At the present time, to evacuate the heat produced by the polishing operation at the level of the rotating plate, the latter is usually provided with a coil through which a cooled liquid such as water circulates.

It will be readily understood that such a coil is delicate to produce and requires for its supply and for the evacuation of the hot water at least two rotary joints which are expensive to construct. Furthermore, it has been ascertained to be frequently advantageous, at least at the beginning of the operational cycle, to heat the plate to optimum temperature.

According to the present invention, heat-conditioning of the rotating plate is thus obtained with the aid of a series of vertical nozzles disposed beneath said plate in order to emit jets of liquid which strike the lower face thereof so as to regulate, by conduction, the temperature of the top surface where the polishing operation is taking place.

There is obviously every interest in collecting the heat-conditioning liquid independently of the slurries or abrasive liquids, with a view to recycling thereof and evacuation or re-use of the abrasives after treatment. To this end, according to the invention, the rotating plate comprises a solid disc rendered fast with a spoked wheel of which the hub is fixed on the conventional drive shaft, whilst the rim is hollowed out on its lower face with a groove forming housing for the upper edge of a fixed collar provided in the lower tank; the central part of this tank thus collects the liquid sprayed by the nozzles which are fixed thereto, whilst the peripheral part recovers the slurries or abrasive liquids coming either directly from the outer zone of the rotating plate, or from the central zone thereof through channels made in the upper face of the spokes of the wheel which are in register with the perforations for evacuation made in the groove provided in the upper face of the solid disc.

The invention will be more readily understood on reading the following description with reference to the accompanying drawings, in which.

Figure 1:
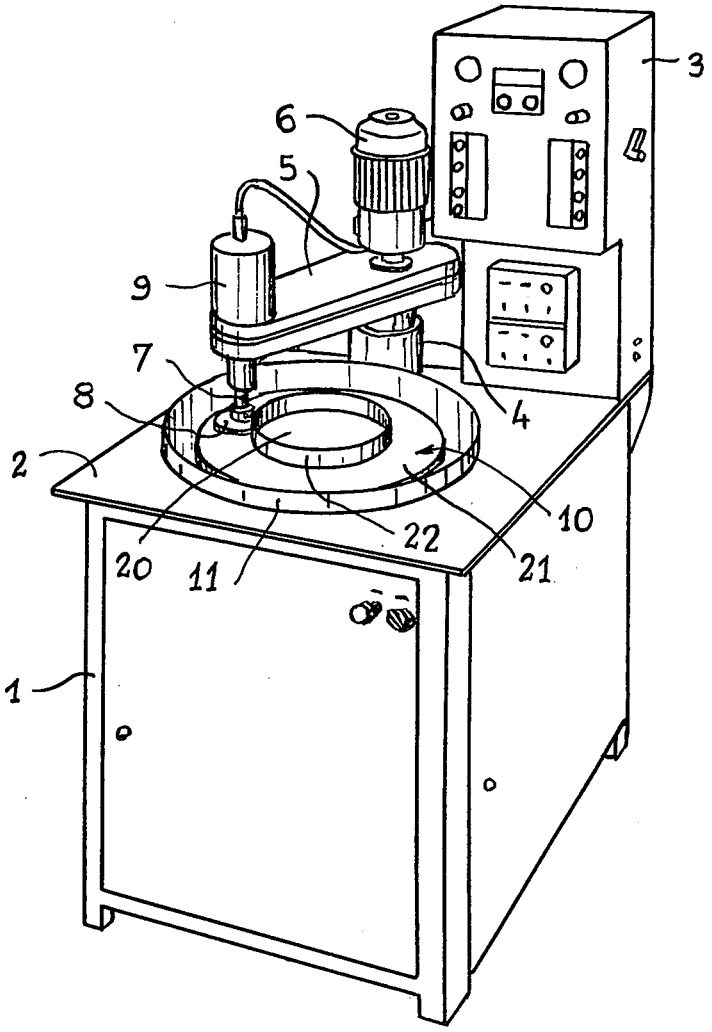
FIG. 1 is a view in perspective of a polishing machine according to the invention.

Referring now to the drawings, the machine shown in FIG. 1 conventionally comprises a frame 1 in the form of a box, provided with an upper table 2. The rear part of this frame 1 is occupied by a vertical console 3 which is equipped with the different devices for actuating and controlling the mobile members of the machine. The table 2 bears an adjustable turret 4 fast with a horizontal arm 5 which extends in overhang and which contains a belt mechanism ensuring transmission between an electric motor 6 mounted at the top of the turret 4 and a vertical shaft 7. The lower end of this shaft 7 receives, in interchangeable manner, a holder 8 adapted to allow fixation of the workpieces to be polished, whilst the top end is associated with a pneumatic jack 9 adapted to move said shaft axially in downward direction.

Such an arrangement is well known in practice and therefore does not need to be described in detail. It suffices to recall that the turret 4 is generally adapted on the one hand to rise or descend in order to modify the height of the arm 5 above the table 2, and on the other hand to move angularly in order to take the holder 8 to any desired point of a rotating plate 10 mounted inside a tank 11 which occupies an opening of circular profile made in the central part of the table 2.

Figure 2:
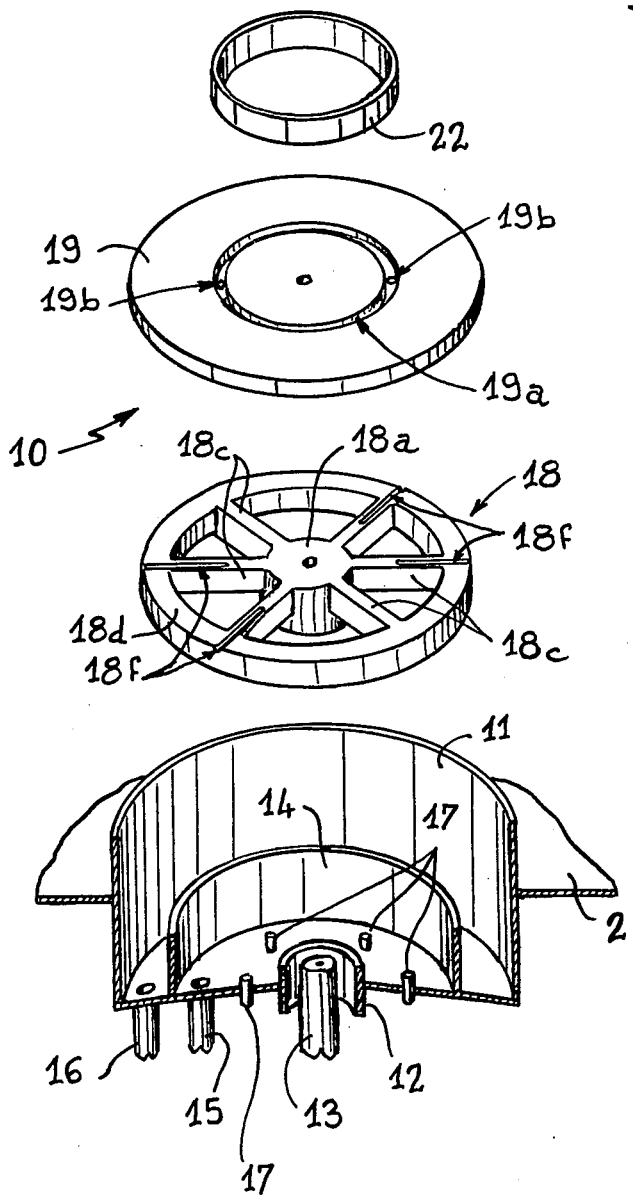
FIG. 2 shows in superposition, prior to assembly thereof, the elements constituting the rotating plate of the machine according to FIG. 1, these elements being shown above the tank which is shown in axial section.
Figure 3:
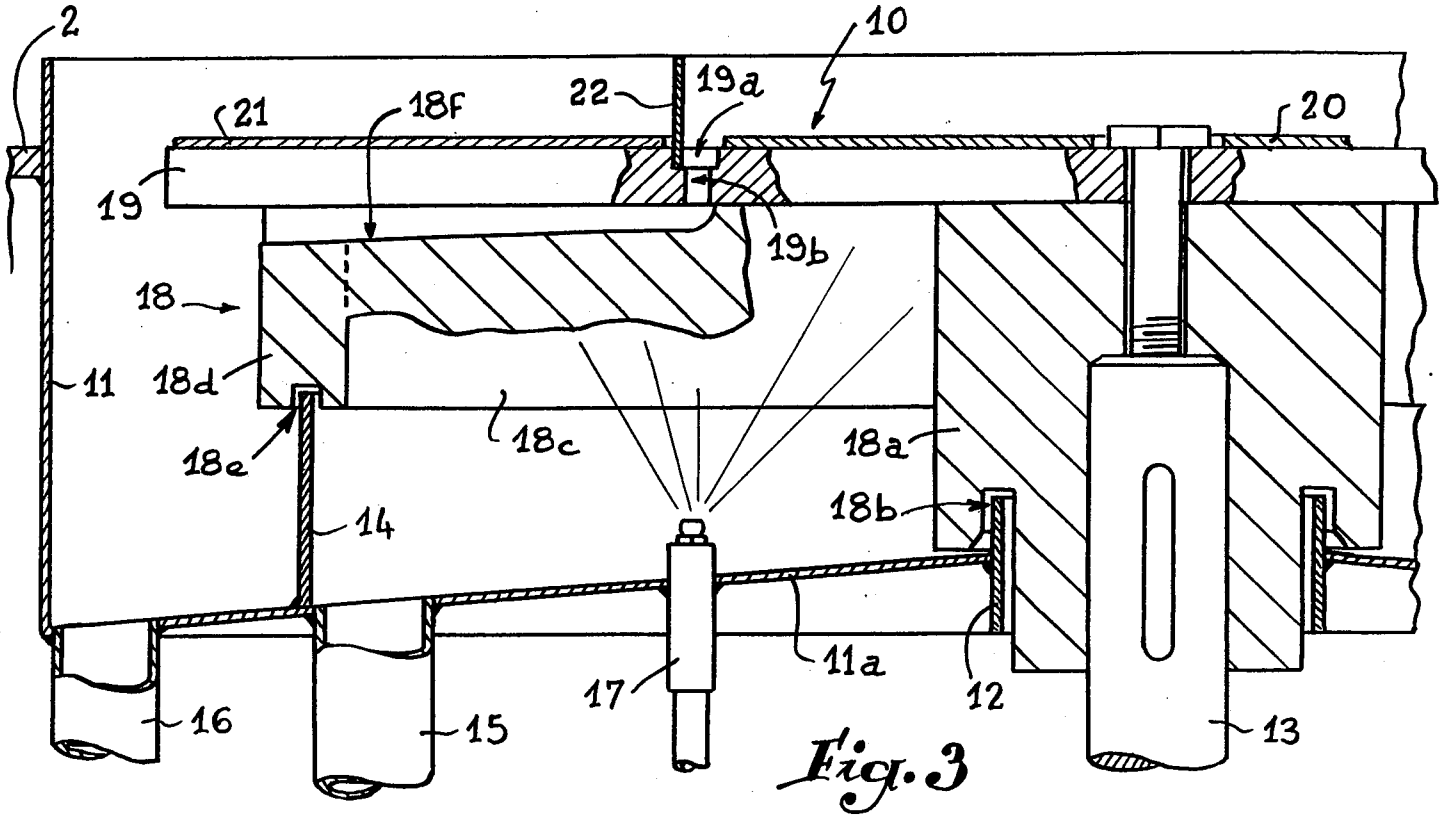
FIG. 3 is a partial, axial section showing, on a larger scale, the rotating plate mounted in the tank.

As illustrated in FIGS. 2 and 3, the upwardly convex bottom 11*a* of the tank 11 bears a central bush 12 oriented axially to surround the vertical shaft 13 adapted to rotate the rotating plate. Between this bush 12 and the cylinder which forms the side wall of the tank, the convex bottom 11*a* is fast with a vertical collar 14 which thus defines two concentric compartments of which each is provided with an evacuation pipe 15, 16. It should be observed that, in the central compartment, the bottom 11*a* has regularly distributed, vertical spray nozzles 17 passing hermetically therethrough, these nozzles being suitably supplied with a heat-conditioning liquid under pressure.

The rotating plate is formed by assembling two separate elements, namely a wheel 18 and a solid disc 19. The wheel 18 comprises a hub 18*a* fixed on the shaft 13 and having an annular housing 18*b* cut out therein to receive the bush 12; this hub 18*a* is connected by spokes 18*c* to a rim 18*d*, the lower face of the latter itself being provided with a groove 18*e* in which is introduced the upper edge of the collar 14. The upper surface of the disc 19, which is rendered fast with the wheel 18 in any suitable manner, presents a groove 19*a* of circular section, in the bottom of which opens a series of perforations 19*b*, which are provided to open downwardly above at least certain of the spokes 18*c*; the upper wall of such spokes is provided with a longitudinal channel 18*f*, which slopes from the centre towards the periphery, as shown in FIG. 3.

It will be readily appreciated that the groove 19*a* in the disc 19 of the rotating plate defines on said disc two distinct concentric zones; as illustrated in FIG. 3, these two zones are advantageously provided with two covering substrates 20 and 21 of different natures. Furthermore, it will be noted that this groove 19*a* serves as seat for the base of a removable collar 22 which, once placed in position, acts as separating screen.

For the first phase of polishing corresponding to rough-machining or roughing the workpiece, the turret 4 and the arm 5 are oriented so that the holder 8 is disposed above the substrate 21 covering the periphery zone of the rotating plate. Once this plate starts to rotate and the motor 6 is energized in order to drive the holder 8, the jack 9 is controlled to apply the workpiece against the substrate 21, which is simultaneously sprayed with a suspension of abrasive. The collar 22 avoids any untimely projection of abrasive on the central substrate 20; under the effect of the centrifugal force, the slurry flows over the outer edge of the plate and is collected in the outer compartment of the tank 11 before being evacuated through the pipe 16.

In the course of this phase of operation, the rotating plate of the machine is thermally conditioned by the liquid, at regulated temperature, which the nozzles 17 project against the lower face of the disc 19. This liquid is collected in the central compartment of the tank and is evacuated through pipe 15, separately from the slurry of abrasive.

For the second phase corresponding to finishing, the holder 8 is transferred from the peripheral zone of the plate to the central zone (substrate 20). The plate is again rotated and it is this central zone which is then sprayed with suspension of abrasive; the slurry is collected in the groove 19*a*, passes through the perforations 19*b* and is collected in the channels 18*f* which evacuate it into the outer compartment of the tank and into pipe 16. Consequently, this slurry cannot be mixed with the heat-conditioning liquid collected in pipe 15. The abrasive slurries and the conditioning liquid may thus be recycled separately.

It will be readily appreciated that the collar 22 can easily be removed from the groove 19*a*, such removal being effected either to facilitate passage of the holder from one to the other of the two zones of the plate when the turret 4 is not equipped with means for vertical displacement, or in order to have a plate with a single zone of operation, this plate then advantageously being covered with one covering substrate obturating the groove 19*a*.

It must be understood that the foregoing description has been given only by way of example and that it in no way limits the domain of the invention whose scope would not be exceeded by replacing the details of execution described by any other equivalents. In particular, the invention may be applied to the rotating plate of lapping and polishing machines.

What is claimed is:

1. In a polishing machine, of the type comprising a rotating workpiece-holder applied by force against a plate itself driven in rotation and sprayed with a suspension of abrasive, the upper face of the plate is hollowed out with a groove of circular section which defines two distinct concentric zones, separated from each other by a removable collar forming screen and of which the base is retained in the said groove, the latter being adapted to collect the slurries and abrasive liquids and to evacuate them through perforations.

2. The machine of claim 1, wherein the two zones of the rotating plate are provided with different covering substrates and are sprayed with different abrasive solutions.

3. The machine of claim 1, wherein the plate is disposed inside a tank whose bottom is provided with a series of nozzles adapted to spray a liquid against the lower face of said plate with a view to ensuring heat-conditioning thereof.

4. The machine of claim 3, wherein the tank comprises two separate compartments for collecting and evacuating, through distinct pipes, the heat-conditioning liquid and the slurries or abrasive liquids coming from the plate.

5. The machine of claim 4, wherein the plate comprises a solid upper disc supported by a spoked wheel, the spokes which are in register with the perforations in the groove for evacuation being hollowed out with a longitudinal channel for the centrifugal flow of the slurries or liquids collected by said groove.

6. The machine of claim 5, wherein the lower face of the rim of the wheel is provided with a groove adapted to receive the upper edge of the collar provided in the tank to define the two concentric compartments thereof and to avoid passage, by splashing, of the heat-conditioning liquid into the abrasive slurry compartment.

* * * * *